United States Patent [19]

Reba et al.

[11] Patent Number: 4,499,801

[45] Date of Patent: Feb. 19, 1985

[54] WEB SLITTING AND GROOVING METHOD

[75] Inventors: Imants Reba, Vancouver, Wash.; Rudolph W. Schutz, Walnut Creek; Nestor Kozbur, Antioch, both of Calif.

[73] Assignee: Crown Zellerbach Corporation, San Francisco, Calif.

[21] Appl. No.: 602,886

[22] Filed: Apr. 23, 1984

Related U.S. Application Data

[62] Division of Ser. No. 422,319, Sep. 23, 1982, Pat. No. 4,484,500.

[51] Int. Cl.[3] ..... B26D 3/08

[52] U.S. Cl. ..... 83/24; 83/99

[58] Field of Search ..... 83/24, 98–100, 83/156, 404.4, 407

[56] References Cited

U.S. PATENT DOCUMENTS

| | | | |
|---|---|---|---|
| 3,135,151 | 6/1964 | Link | 83/100 |
| 3,156,149 | 11/1964 | Frizelle | 83/100 |
| 3,282,525 | 11/1966 | Rehr | 242/56.2 |
| 3,741,052 | 6/1973 | Frost et al. | 83/24 |
| 4,401,004 | 8/1983 | Glans et al. | 83/98 X |

*Primary Examiner*—James M. Meister
*Assistant Examiner*—John L. Knoble
*Attorney, Agent, or Firm*—Thomas R. Lampe

[57] ABSTRACT

A system for slitting a parent web to form grooved rolls including movable shear slitters and a Coanda nozzle device for removing trim segments from the shear slitters.

3 Claims, 9 Drawing Figures

20
73
77
76
74
78
84
82
90
54
50
60
62
56
66
70
5
W

WEB SLITTING AND GROOVING METHOD

This application is a division of Ser. No. 422,319, filed Sept. 23, 1982, now U.S. Pat. No. 4,484,500.

BACKGROUND OF INVENTION

1. Field of Invention

This invention relates to an apparatus and method for manufacturing a grooved automatically dismountable roll paper product.

2. Description of the Prior Art

U.S. Pat. No. 3,038,598 issued June 12, 1962 to Layton et al., relates to an automatically dismountable roll of strip material which has a bearing wall adapted to be supported upon an appropriate supporting member in a dispenser cabinet and to be automatically dismounted therefrom when it has been consumed to a predetermined extent. U.S. Pat. No. 3,089,659 issued May 14, 1963 to J. L. Perrin discloses the method of automatically dismounting the roll product of U.S. Pat. No. 3,038,598. The bearing wall is formed by the convolutions of the roll product which are relatively disposed to form a recess or detent in the end of the roll. U.S. Pat. No. 3,282,525 issued Nov. 1, 1966 to H. W. Rehr illustrates an apparatus and method which have been utilized to form the recess and bearing surface. According to this latter patent score slitters are employed to cut a trim segment of material from the web forming the roll prior to winding thereof. The arrangement disclosed in the aforesaid Rehr patent has certain drawbacks that have limited its commercial application. First of all, it has been found that the score slitters of the Rehr arrangement are prone to excessive wear of not only the slitter knives but the platen rolls as well. Replacement of these components has resulted in excessive downtime and consequent production loss. Secondly, and at least of equal importance, has been the fact that difficulties have been encountered in removal of the trim segment. It will be appreciated that the trim segment produced by the system of the Rehr patent will result in formation of a very fine lead and tail end of the trim segment. There has been a tendency for these ends to stick to the rest of the web or the slitting knives, producing an unsightly finished product and/or leading to operational problems due to waste build-up on the machinery itself. This is particularly the case at high production speeds. Conventional pneumatic trim removal system have failed to rectify these matters. While such conventional arrangements are satisfactory for removal of long continuous trim strips the aforesaid difficulties occur when employed to remove thin trim segments.

BRIEF SUMMARY OF THE INVENTION

According to the teachings of the present invention a spirally wound paper roll product having a bearing wall formed by the convolutions of the roll product is produced on apparatus so constructed as to carry out the slitting of the parent web from which the roll product is formed by shear slitters. The shear slitter arrangement of the present invention slits the parent web into separate web segments each of which has a trim segment removed therefrom to create a bearing wall upon winding of the web segment into the finished roll product. Such an arrangement is faster and more efficient than prior art score slitter systems and is less subject to component wear. The present system also incorporates an improved trim segment removal means which cooperates with the trim segment and the remainder of the web from which it is being cut to facilitate removal of the trim segment and direct same to a predetermined location spaced from the remainder of the web. Further, the trim segment removal means exerts fluid forces at the locations of the shear knives employed in the apparatus to remove any slivers of web that may have adhered thereto.

DETAILED DESCRIPTION

Figure 3:
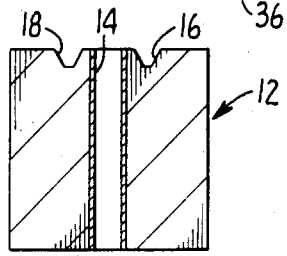
FIG. 3 is a longitudinal sectional view of a roll product produced in accordance with the teachings of the present invention.
Figures 4, 5, 5A:
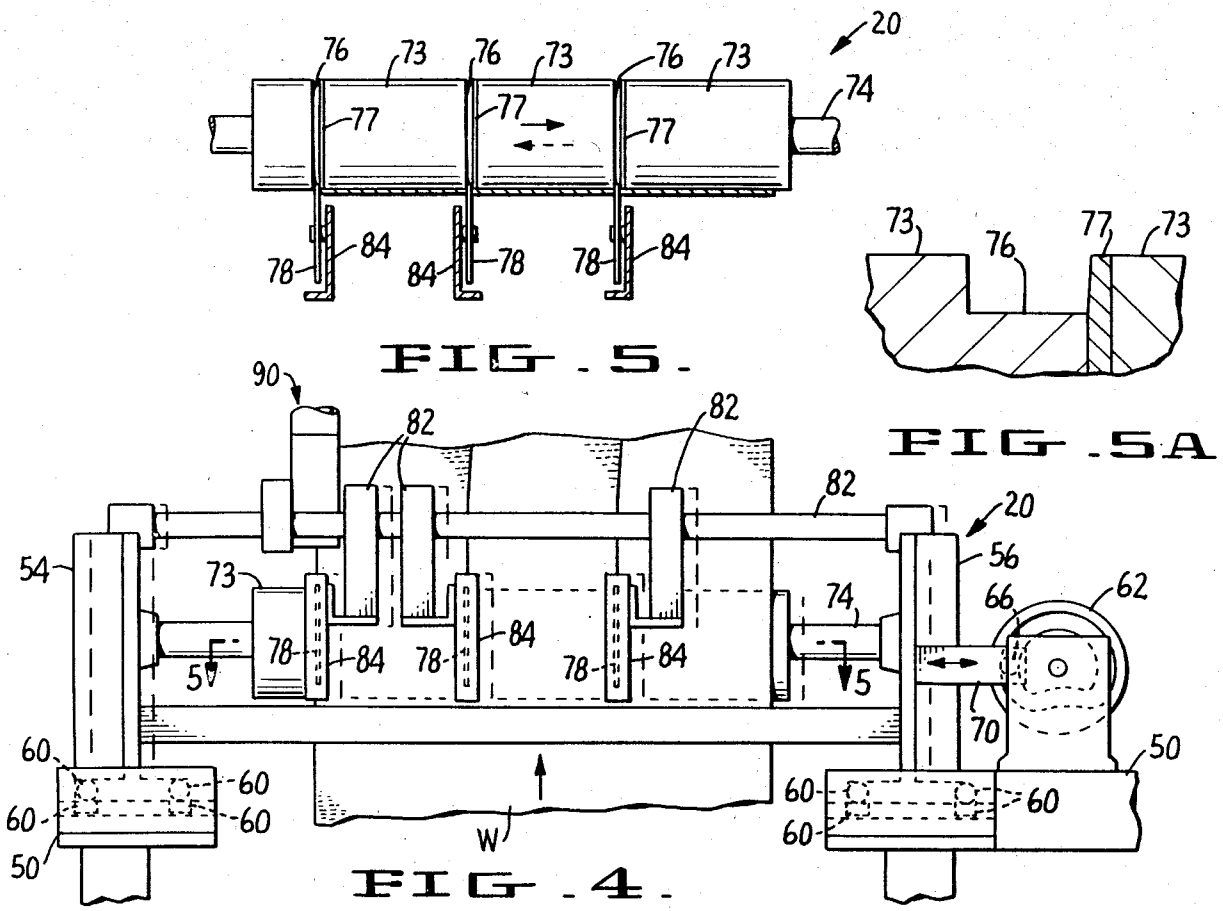
FIG. 4 is a cross sectional view taken along the line 4—4 in FIG. 1.
FIG. 5 is a cross sectional view taken along the line 5—5 in FIG. 4.
FIG. 5A shows an enlarged detail of that component of the device illustrated in FIG. 5.
Figure 6:
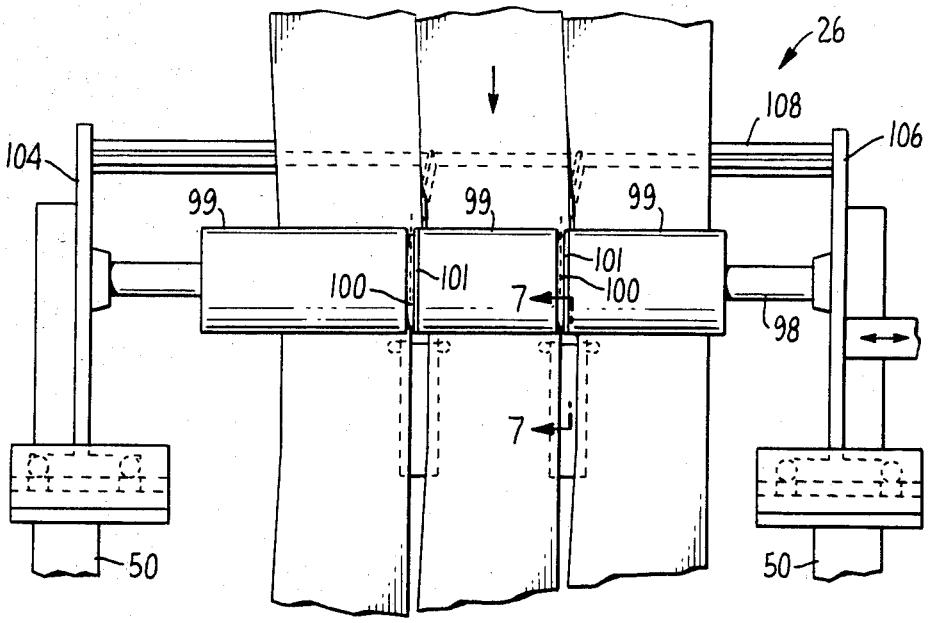
FIG. 6 is a cross sectional view taken along the line 6—6 of FIG. 1.
Figure 8:
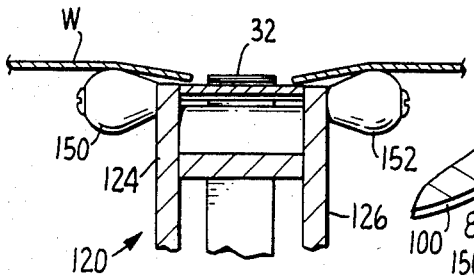
FIG. 8 is a cross sectional view taken along the line 8—8 in FIG. 7.
Figure 7:
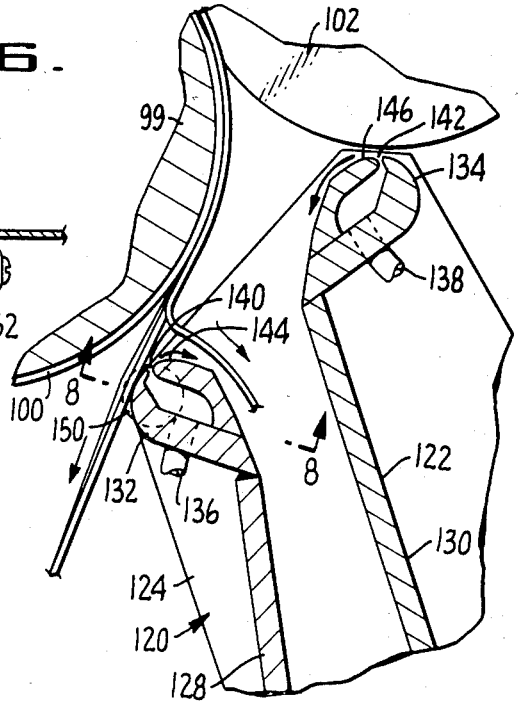
FIG. 7 is an enlarged cross sectional view taken along the line 7—7 in FIG. 6.

The apparatus and method of the present invention are utilized to produce a spirally wound paper roll product of the general type shown in FIG. 3 and identified generally by reference numeral 12. Roll product 12 includes a core 14 about which layers of paper web have been wound in conventional fashion. It will be seen that a groove 16 is formed at one end thereof. In the particular form shown in the drawings such groove is generally V-shaped in cross section, however, the angle defined by the sidewalls of the groove can be increased or decreased, the depth of the groove can be changed, as can the shape thereof. As will be seen below, the groove is formed by relatively movable shear slitter assemblies and the characteristics of the groove are changed by modifying such relative movement. A bearing wall 18 is formed in the roll by the convolutions of the roll product in the vicinity of the groove. Bearing wall 18 is adapted to provide a support surface for the roll when it is mounted in a dispensing cabinet of the type shown, for example, in the aforesaid U.S. Pat. No. 3,089,659. When all or most of the convolutions of the paper web defining the bearing wall 18 are used up the roll will drop from its associated support in the cabinet in the manner shown in this last referenced letters patent. The roll product illustrated in FIG. 3 is prior art and does not form a portion of the present invention, which rather is directed to a specific apparatus and method for producing such roll product.

Figure 1:
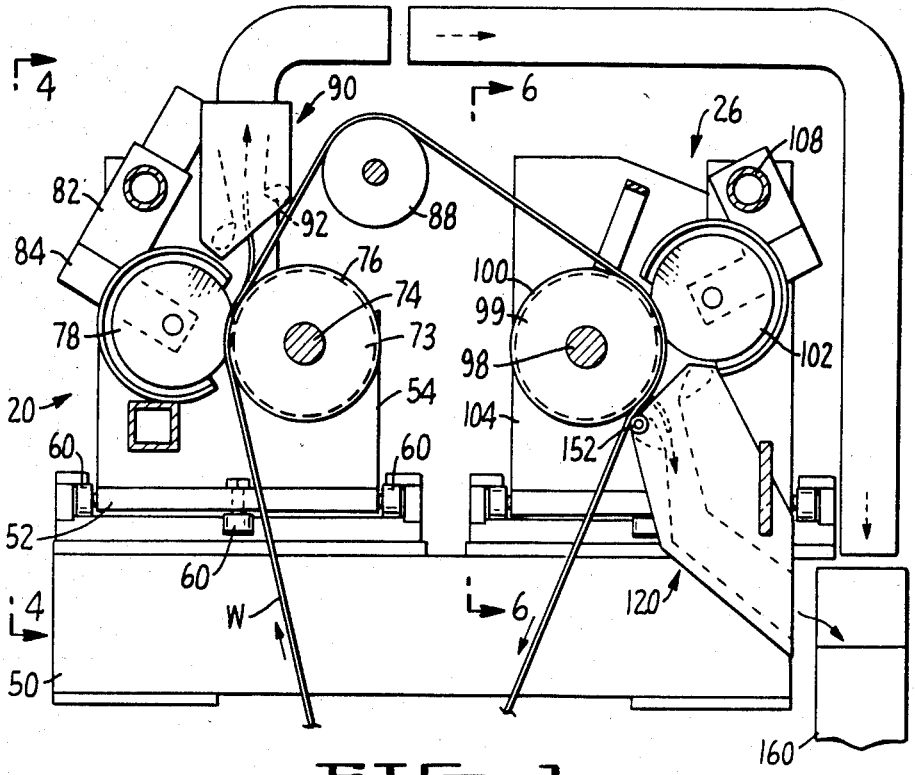
FIG. 1 is a diagrammatic view in side elevation of apparatus constructed in accordance with the teachings of the present invention.
Figure 2:
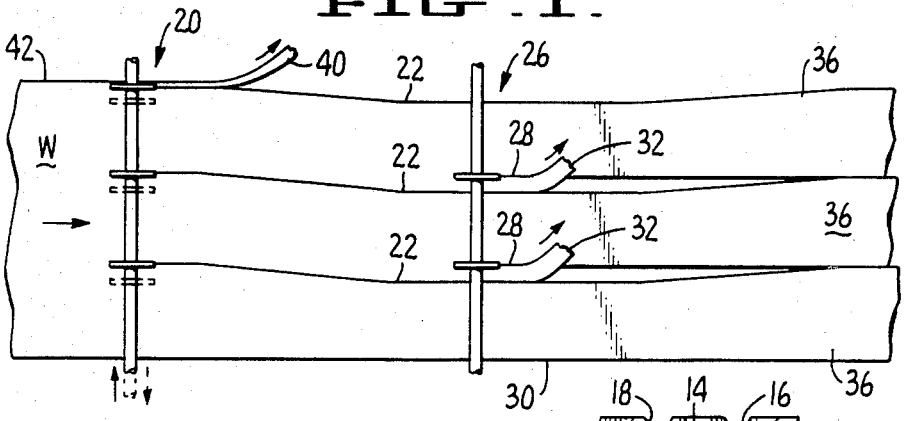
FIG. 2 is a diagrammatic view in broken top plan illustrating the method of slitting a parent web in accordance with the teachings of the present invention.

FIG. 2 illustrates schematically the method of the present invention as applied to a parent web W moving from left to right as viewed in that figure. The parent web W first passes through a first paper web cutting assembly 20 which will be described in greater detail below. Assembly 20 is reciprocally movable transversely relative to the direction of movement of the parent web W to form lines of cut including offset portions 22. The web then continues past a second paper web cutting assembly 26. Second paper web cutting assembly 26 forms slits 28 in the web parallel to each other and to an edge 30 of the web. It will be appreciated that trim segments 32 will be formed in the parent web where slits 28 do not register with the lines of cut formed in the parent web by first paper web cutting assembly 20, i.e. at those locations where slits 28 are spaced from offset portions 22. After slitting of the web W takes place by the cutting assemblies 20 and 26 and the trim segments 32 have been removed therefrom, the separate web segments 36 are wound onto cores at a conventional rewinder or roll winding station (not shown) in the manner illustrated for example in aforesaid U.S. Pat. No. 3,282,525 to form separate roll products 12. In addition to trim segments 32 other trim, trim strip 40, will be formed solely by the reciprocating action of first paper web cutting assembly 20. Trim strip 40 is defined by the initial edge 42 of the parent paper web W and offset line of cut portion 22 formed adjacent to edge 42. As will be seen below, both cutting assemblies 20 and 26 are capable of reciprocal movement. In FIG. 1, assembly 20 was moved and assembly 26 held stationary. If it is desired to form a groove at the edge 30 of the parent web this relationship would obviously be reversed. Alternatively, grooves could be generated at both parent web edges by moving both cutting assemblies.

Referring now to FIGS. 1 and 4–8, the apparatus for carrying out the method of the present invention is illustrated in greater detail. The first paper web cutting assembly 20 of the device is mounted on a framework 50. Assembly 20 includes a bottom plate 52 and side plates 54 and 56 welded or otherwise secured thereto. Rotatably attached to side plates 54 and 56 are a plurality of rollers 60 positioned within channels formed in framework 50 and providing support for assembly 20. It will be appreciated that assembly 20 is thus capable of reciprocal motion relative to the framework. In the arrangement illustrated such reciprocal motion is imparted to assembly 20 by means of a cam and follower arrangement. More particularly a grooved cam element 62 is rotatably mounted on framework 50. A follower element 66 is disposed in the groove of cam element 62 and is integrally connected to side plate 56 by structural member 70. Cam element 62 is connected to any suitable drive mechanism. A preferred approach is to connect the cam element to the drive of the rewinder (not shown) through a suitable clutch mechanism which is engaged and disengaged in a programmed sequence to determine the position of the finished groove in each successive roll. The size of the groove may be varied as desired by utilizing a suitable transmission between the rewinder drive and cam drive mechanism. As cam element 62 rotates, structural member 70 and consequently assembly 20 will move back and forth as shown by the double headed arrow in FIG. 4. Rotatably mounted in journals formed in side plates 54, 56 and comprising a portion of assembly 20 is a shaft 74 having a plurality of sleeves 73 disposed thereon defining spaced grooves 76. Anvil knives 77 are disposed between the sleeves to define a side wall of each groove as shown in FIG. 5A. Selectively positionable within grooves 76 in shear cut relationship with anvil knives 77 are a plurality of circular knife blades 78 which are freely rotatably mounted on a blade mounting assembly 82 also extending between side plates 54 and 56. Blade mounting assembly 82 is pivotally mounted relative to the side plates so that the entire blade mounting assembly may be manually or mechanically pivoted with respect thereto to place the knife blades 78 into and out of engagement with anvil knives 77. The knife blades are rotatably mounted on L-shaped structural members 84 comprising part of the blade mounting assembly 82.

The parent web W which is driven by any suitable means (not shown) passes through the shear slitters defined by the circular knife blades 78 and the anvil knives 77. As may perhaps best be seen with reference to FIG. 1, the web W then proceeds around an idler roll 88. In the vicinity of the shear slitter adjacent to the edge 42 of the web is an edge trim removal device 90 for removing trim strip 40 from the parent web and conveying strip 40 to a predetermined location such as trim collector 160. Disposed at the open end of edge trim removal device 90 are two Coanda nozzles 92 which when activated induce a fluid flow within the interior of device 90 in the direction illustrated by the dashed arrow in FIG. 1. Such flow is comprised of the compressed air flow from the nozzles 92 themselves in combination with the ambient air entrained thereby. Coanda nozzles 92 may be of any suitable construction but are preferably of the two dimensional type. Any suitable construction may be employed because trim strip 40 is in the form of a continuous ribbon albeit one that varies in width. The nozzles are selectively connected to a suitable source of compressed air (not shown) also as well known in the prior art.

After passing around idler 88 the web progresses to second paper web cutting assembly 26. As is the case with assembly 20 the assembly 26 includes a shaft 98 having sleeves 99 about the periphery thereof to define grooves 100 and a plurality of anvil knives 101 positioned between the sleeves. Circular knife blades 102 are positionable within the grooves to define spaced shear slitters with the anvil knives for again slitting the parent web. Assembly 26 preferably is mounted on rollers and is selectively reciprocally mounted to move relative to the crosswise direction of web W. Shaft 98 is journaled at its ends in suitable bearings in side walls 104 and 106 roller mounted with respect to framework 50. As was the case with knife blades 78, freely rotatable knife blades 102 are connected to L-shaped members depending from a cross bar 108 pivotally connected to side walls 104 and 106 so that the blades may be manually or mechanically selectively placed into and out of engagement with the anvil knives 101.

Trim segment removal means is positioned closely adjacent to second assembly 26 to exert forces on trim segments 32 produced at such location and on the remainder of the parent web to remove the trim segments and direct them to a predetermined location spaced from the remainder of the parent web. The details of the trim segment removal means perhaps best be seen with reference to FIGS. 6, 7 and 8 wherein such means is designated generally by reference number 120.

A trim segment removal means 120 is positioned in registry with and closely adjacent to each groove 100 and the circular knife blade 102 positionable within the groove. The trim segment removal means 120 are preferably mounted on the cross bar 108 along with blades 102 so that they can be swung out of the way when the blades are moved out of engagement with the anvil knives. Each trim segment removal means 120 includes an open ended conduit 122 defined by conduit side walls 124 and 126 and interconnecting conduit walls 128 and 130 which flare out in Venturi fashion. At the upper or mouth end of conduit 122 are disposed Coanda nozzles 132 and 134 which are selectively connected through hoses 136 and 138 to a suitable source of air pressure (not shown). As is conventional with Coanda nozzles, when the interiors of nozzles 132 and 134 are filled with pressurized gas such gas will be emitted from exit slits 140 and 142 extending between the conduit side walls and be attached to generally curved Coanda surfaces 144 and 146 which direct fluid flow into the interior of the conduit. This flow of pressurized gas will entrain ambient air therewith so that the combined fluid flow within the conduit interior is comprised not only of the pressurized gas being emitted from the Coanda nozzles but also the ambient air entrained thereby. Coanda nozzle 132 also serves to exert a force perpendicular or normal to the web path. Such pulling force is applied not only to trim segment 32 but also to the remainder of the parent web in the immediate vicinity of the trim segment.

Attached to conduit side walls 124 and 126 are tapered knob numbers 150 and 152 which press against the parent web W at spaced locations adjacent opposite sides of trim segment 32, said spaced locations being disposed a predetermined distance from the trim segment and cooperating with the web pulling Coanda nozzle 132 to manipulate the web to facilitate separation between the trim segment and the remainder of the web. Specifically, and perhaps as may best be seen with reference to FIG. 8, the normal force exerted by the fluid flow within the conduit and the generally oppositely directed forces of the tapered knobs pressing against the web will cause the web to be drawn away at the lines of cut forming the trim segment and cause separation at said lines of cut. The trim segment will then be drawn by the fluid flow within the conduit away from the web W after separation between the trim segment and the remainder of the parent web has been facilitated. This action is particularly important at the leading and trailing ends of the trim segment which are extremely fine in character. With the present arrangement even those hairlike portions of the trim segment can be virtually removed in toto and will not interfere with operation of the equipment at high speeds nor adversely influence product quality. If desired, to conserve energy the flow of pressurized air to the nozzles may be interrupted when no trim segment is being cut.

It is highly desirable that the outer surfaces of knobs 150 and 152 be extremely smooth. Chrome plated brass has been found to be one suitable material for this purpose. Insofar as the dimensions and pressures of the Coanda nozzles 132 and 134 are concerned, apparatus constructed in accordance with the teachings of the present invention has been employed utilizing an air slit of 0.002 inches and such nozzle has been operated in the general pressure range of 10–12 psig.

It will be noted that Coanda nozzle 134 is positioned closely adjacent to knife blade 102. In addition to inducing fluid flow within conduit 122, Coanda nozzle 134 performs the additional function of exerting strong fluid flow at the cutting edge of the knife blade. This action removes any slivers which may attach to or wrap about the slitter blade during operation of the present invention. All of the waste material delivered by conduit 122 will be delivered to a suitable location such as trim collector 160.

It will be appreciated that the character of the groove 16 of the finished product may be readily varied by changing the configuration and/or rotational speed of the cam element 62.

We claim:

1. In a method of making a spirally wound paper roll product having a bearing wall formed by the convolutions of the roll product, the steps of:

transporting a parent web along a predetermined path of movement;

at a first location along said path of movement, performing a first slitting operation on said parent web to form lines of cut therein and divide said parent web into separate web segments;

at a second location downstream from said first location, performing a second slitting operation on said parent web segments along lines of cut;

periodically moving at least one of said slitting operations transversely relative to said parent web so that portions of at least some lines of (f) cut are of set and out of registry periodically so that trim segments are formed;

inducing a fluid flow closely adjacent to said second location;

removing said trim segments from the remainder of said parent web at said second location by entraining said trim segments in said fluid; and exerting forces on said parent web to manipulate said parent web and facilitate removal of said trim segments from the remainder of said parent web by providing pressure against said parent web at oppositely disposed positions across said trim segments and spaced therefrom while said trim segments are entrained in said fluid flow, said fluid flow being induced by passing a high speed fluid flow through a restricted opening generally located between said pressure positions, attaching said high speed fluid flow to a Coanda surface leading from said restricted opening, and entraining ambient air in the direction of said Coanda surface.

2. The method of claim 1 wherein said fluid flow is additionally induced at a second location spaced from said restricted opening through utilization of the Coanda effect.

3. In a method of making a spirally wound paper roll product having a bearing wall formed by the convolutions of the roll product, the steps of:

transporting a parent web along a predetermined path of movement;

at a first locaton along said path of movement, performing a first slitting operation on said parent web to form lines of cut therein and divide said parent web into separate web segments;

at a second location downstream from said first location, performing a second slitting operation on said parent web segments along lines of cut;

periodically moving said slitting operation at said second location transversely relative to said parent web so that portions of at least some lines of cut are offset and out of registry periodically so that trim segments are formed;

closely adjacent to at least one trim segment, inducing a fluid flow at said second location by passing a high speed fluid flow through a restricted opening and entraining ambient air with said high speed fluid flow;

attaching said high speed fluid flow to a Coanda surface leading from said restricted opening and away from said parent web;

removing said at least one trim segment from the remainder of said parent web at said second location by entraining at least one said trim segment in said fluid flow;

facilitating removal of said at least one trim segment from said parent web by supporting said parent web on pressure surfaces at oppositely disposed positions across said at least one trim segment and spaced therefrom while said at least one trim segment is entrained in said fluid flow; and simultaneously moving said restricted opening, said Coanda surface, and said pressure surfaces at said second location transversely relative to said parent web along with said moving slitting operation.

* * * * *